United States Patent [19]

Furuichi et al.

[11] 4,370,752

[45] Jan. 25, 1983

[54] DEVICE FOR STABILIZING TUBE CURRENT IN X-RAY PHOTOGRAPHING APPARATUS

[75] Inventors: Shuhei Furuichi, Kyoto; Masakazu Suzuki, Naka, both of Japan

[73] Assignee: Kabushiki Kaisha Morita Seisakusho, Kyoto, Japan

[21] Appl. No.: 319,925

[22] Filed: Nov. 10, 1981

Related U.S. Application Data

[63] Continuation of Ser. No. 54,691, Jul. 5, 1979, abandoned.

[30] Foreign Application Priority Data

Jul. 7, 1978 [JP] Japan ..... 53/83215

[51] Int. Cl.[3] ..... H05G 1/30

[52] U.S. Cl. ..... 378/110; 378/101

[58] Field of Search ..... 378/110, 109

[56] References Cited

U.S. PATENT DOCUMENTS 3,567,995 3/1971 Lauritzen ..... 37 8/110

4,072,865 2/1978 Craig ..... 378/110

*Primary Examiner*—Craig E. Church

*Attorney, Agent, or Firm*—Koda and Androlia

[57] ABSTRACT

This device feeds back an output proportional to the electric current flowing through an X-ray tube to a filament current controlling means, reads out a difference between the increase and decrease in the current of the X-ray tube made by the effect of charge on the wall of the X-ray tube, and constantly stabilizes the current in the tube at the optimum value by increasing and decreasing a filament current in response to the difference read out.

1 Claim, 3 Drawing Figures

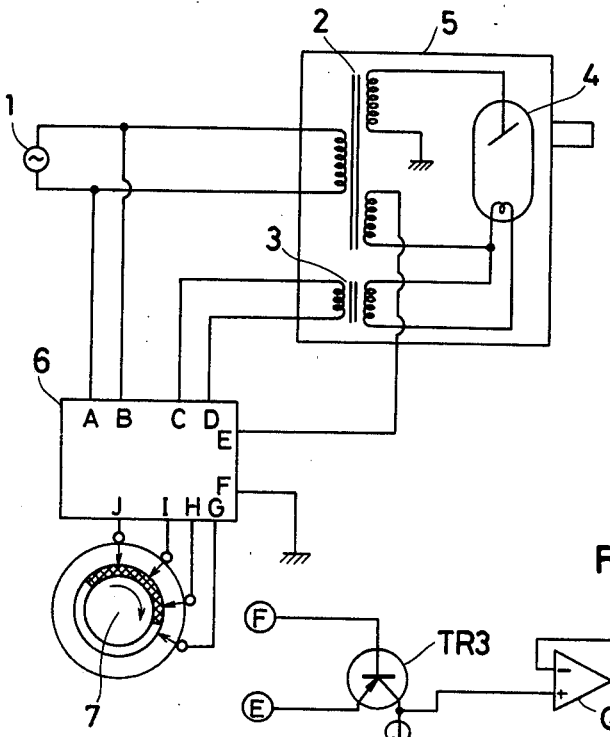
FIG. 1
FIG. 2
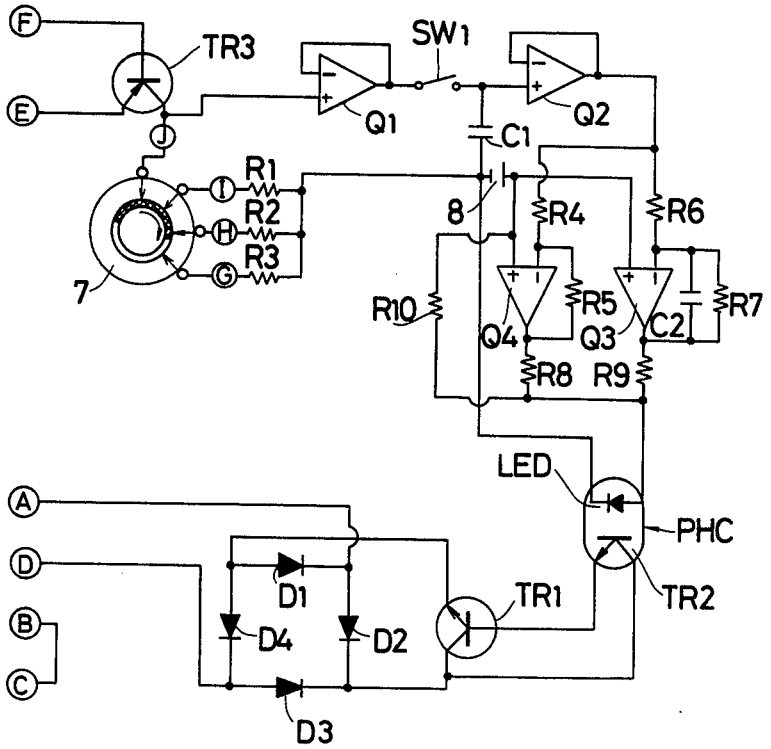

DEVICE FOR STABILIZING TUBE CURRENT IN X-RAY PHOTOGRAPHING APPARATUS

This is a continuation of application Ser. No. 054,691, filed July 5, 1979, now abandoned.

BACKGROUND OF THE INVENTION

1. Field of the Invention

This invention relates to a device for stabilizing the current of X-ray tube in an X-ray photographing apparatus.

2. Prior Art

When the time required for photographing by an X-ray photographing apparatus is relatively long, it is necessary for the apparatus to make constant the current in the X-ray tube during photographing in order to uniform the density of an X-ray photograph taken, and it is a common practice for the apparatus to be integrally equipped with a constant-voltage transformer or the like to adjust supply voltage fluctuations. But the conventional apparatus was not free from disadvantages such as variations in the X-ray tube current due to deterioration in each element constituting the X-ray tube in proportion to the number of years during which the tube was used, reductions in the strength of X-rays due to the charge collected on the tube wall by effect of time during production of X-rays and to reductions in the velocity of electron beams made by the charge thus collected and to resultant gradual decrease in the tube current along with the progress of photographing, and so on.

SUMMARY OF THE INVENTION

In view of the disadvantages described above, this invention is directed to stabilizing the current in an X-ray tube invariably by feeding back an output proportional to the current flowing through the X-ray tube to a filament current controlling means, reading out a difference between the increase and decrease made in the current in the X-ray tube by electric charge on the wall surface of the X-ray tube, and increasing and decreasing the filament current in response to the difference One preferred embodiment of the invention will now be described with reference to the accompanying drawings.

BRIEF DESCRIPTION OF THE DRAWINGS

In the drawings:

FIG. 1 is a performance circuit of an X-ray tube;

FIG. 2 is a diagram showing an embodiment of construction of a filament current controlling circuit.

DETAILED DESCRIPTION OF THE INVENTION

Figure 3:
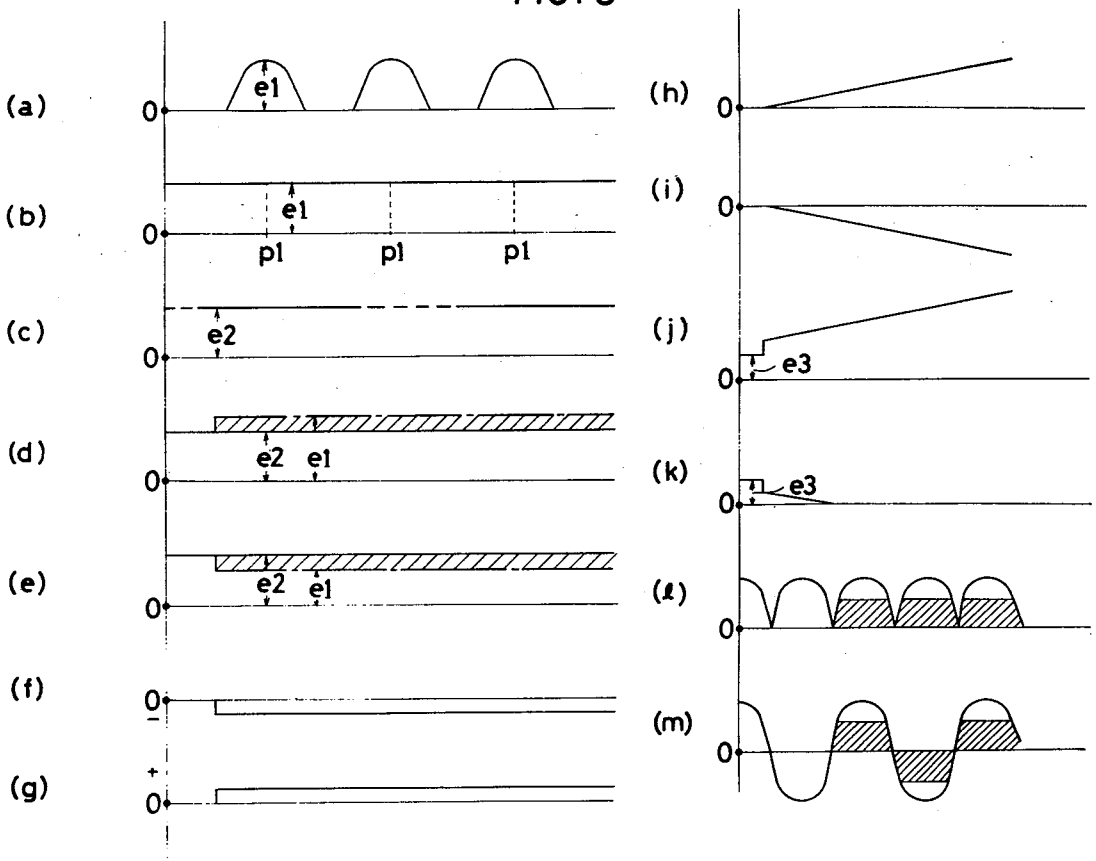
FIG. 3 is a timing chart of FIG. 2.

Referring now to the drawings and particularly to FIG. 1, the numeral 1 designates commercial alternating current power supply; 2 a high voltage transformer; 3 a filament current transformer; 4 an X-ray tube; and 5 designates a casing for enveloping member 2–4 which are connected to one another by a known method. The numeral 6 designates a tube current stabilizing circuit including a filament current controlling means constituting an essential part of the invention, and a rotary switch 7 for selecting a tube current is connected to the circuit 6.

FIG. 2 shows one embodiment of the tube current stabilizing circuit, which is constructed to permit the tube current obtained from the secondary side of a high voltage transformer 2 to input terminals E and F. The terminals B and C are short-circuited and terminals A and D are connected to a filament current controlling means. Reference characters D1–D4 designate full-wave rectifying diodes (which constitute a bridge retifier). The diodes D1–D4 vary the current between the terminals A and D by converting alternating current voltage into a full-wave pulsating current and controlling the pulsating current through a transistor TR1. The reference character PHC designates a photocoupler of known construction consisting of a light emission diode LED and a phototransistor TR2. The photocoupler is connected so as to make the phototransistor TR2 energize the transistor TR1 in accordance with the amount of light received from the light emission diode LED. On the other hand, transistor TR3 obtains voltage proportional to the input current (tube current) of terminals E and F and forms a kind of I-V conversion circuit. In the conversion circuit, the coefficient of conversion of the transistor TR3 is in proportion to the resistance value of resistors R1–R3 connected in series through a rotary switch 7 to the collector of the transistor TR3, and therefore selective connection of any one of the resistors R1–R3 by use of the rotary switch 7 provides any desired current of the X-ray tube. Amplifiers Q1 and Q3 and synchronous switch SW1 form a sample holding circuit, and because the output of the transistor TR3 is a half-wave pulsating current, the output cannot make stabilized control by itself and accordingly the output is converted into a direct current by the sample holding circuit. The synchronous switch SW1 turns on and off in synchronism with the frequency of power supply and turns on in phase most suitable to sample holding (at peak value in the embodiment shown), and accordingly the switch functions to charge a condenser C1 with voltage at peak value and hold the voltage. The numeral 8 designates a DC constant-voltage regulated power supply. A differential amplifier Q3, condenser C2 and resistors R6 and R7 constitute an integration circuit, and a differential amplifier Q4 and resistors R4 and R5 constitute a linear amplifier circuit. The numerals R8 and R9 designate summing resistors and R10 designates a bias current supplying resistor for light emission diode LED. The above integration circuit is intended to zero long-period fluctuations and constant deviation when the output of transistor TR3 is different in voltage from the constant-voltage regulated power supply 8, and the linear amplifier circuit makes quick-responsive automatic control so as to make the output of the transistor TR3 equal to the constant-voltage regulated power supply 8.

Referring now to actual circuit operation with reference to the timing chart of FIG. 3, the transistor TR3 produces an output voltage of half-wave pulsating current shown in FIG. 3*a* in proportion to a tube current. In the sample holding circuit, the synchronous switch SW1 turns on at the peak value of output voltage a and charges the condenser C1 with electricity, so that, as shown in FIG. 3*b*, DC output voltage e1 having a holding point P1 is applied to the integration circuit and linear amplifier circuit. In both circuits is detected a difference between the output e1 of the sample holding circuit shown in FIG. 3*b* and the output of the constant-voltage regulated power supply shown in FIG. 3*c*, and depending upon the case wherein the output e1 of the sample holding circuit is greater as shown in FIG. 3*d* and upon the case wherein it is smaller as shown in FIG. 3*e*, an output (FIGS. 3*f* and 3*g*) proportional to the difference is applied to the output end of the linear amplifier circuit and the output (FIGS. 3*h* and 3*i*) that integrated the difference is applied to the output end of the integration circuit. The voltage of these two outputs is added to resistors R8 and R9 and is developed into voltage (FIGS. 3*j* and 3*k*) multiplied by voltage e3 which determines depending upon the bias current supplying resistor R10 of the light emission diode, and thus brings the light emission diode LED of the photocoupler into lighting. In short, when the output (the tube current) of amplifier Q2 in the sample holding circuit is larger than the constant-voltage regulated power supply 8 (FIG. 3*d*), both the integration circuit and the linear amplifier circuit produce negative output (FIGS. 3*f* and e1) to thereby decrease the energization of the light emission diode LED, and conversely when the output of amplifier Q2 is smaller than the constant-voltage regulated power supply 8 (FIG. 3*e*), both the integration circuit and linear amplifier circuit produce positive output (FIGS. 3*g* and 3*h*) to thereby energize the light emission diode LED powerfully. Consequently the output of rectifier circuit (FIG. 3*e*) consisting of diodes D1–D4 is controlled because the base bias of transistor TR1 is controlled by phototransistor TR2, and in response to the control of the output of the rectifier circuit, the current between the terminals A and D (FIG. 3*m*) is also controlled, and the primary side of the filament transformer 3 is energized in the direction in which the tube current of the X-ray tube 4 is decreased or increased.

In this manner, the invention detects the current actually flowing through the X-ray tube, compares the tube current with a reference tube current and controls the voltage or current on the primary side of the filament transformer in response to the difference obtained by the comparison, so that the current flows through the X-ray tube always at the optimum value. Accordingly, the invention provides the advantage of permitting the use of the X-ray tube at the optimum tube current value irrespective of the change in characteristics due to the charge of the tube wall, reductions in performance due to deterioration in the X-ray tube, fluctuations in supply voltage and the like.

It should be apparent to those skilled in the art that the above described embodiment is merely illustrative of but one of the many possible specific embodiments which represents the application of the principles of the present invention. Numerous and varied other arrangements can readily be devised by those skilled in the art without departing from the spirit and scope of the invention.

What is claimed is:

1. In an X-ray photographing apparatus of the type including an X-ray tube and a high voltage and filament transformer coupled respectively to the anode and filament of said X-ray tube, X-ray tube current stabilizing means comprising:

a means for detecting a tube current of said X-ray tube;

a means for setting a reference tube current level;

a comparing means for comparing said detected tube current with said reference tube current and for producing an output proportionate to said comparison, said comparing means comprising:

an integration circuit comprising a first amplifier with an integrating capacitor thereacross, said first amplifier having said detected tube current applied to one input and said reference tube current applied to another input thereof; and a second amplifier coupled in parallel with said integration circuit, said second amplifier having said detected tube current applied to one input and said reference tube current applied to another input, said second amplifier further having an output thereof coupled to an output of said first amplifier and forming an output of said comparing means; and a means for controlling said tube current on a primary side of said filament current transformer in response to said output of said comparing means such that said tube current is brought into agreement with said reference tube current.

* * * * *